United States Patent [19]

Thompson

[11] Patent Number: 5,008,985

[45] Date of Patent: Apr. 23, 1991

[54] ZIPPER SECURING DEVICE

[76] Inventor: Allister W. Thompson, #1105-1100 Harwood St., Vancouver, B.C., Canada, V6E-1R7

[21] Appl. No.: 133,871

[22] Filed: Dec. 15, 1987

[51] Int. Cl.[5] ..... A44B 19/26; A44B 13/00

[52] U.S. Cl. ..... 24/370; 24/3 H; 24/429; 294/3.6

[58] Field of Search ..... 24/370, 419, 429, 437, 24/3 R, 3 H, 3 M, 546; 294/3.6

[56] References Cited

U.S. PATENT DOCUMENTS

| | | | |
|---|---|---|---|
| 660,990 | 10/1900 | Houghton | 24/546 |
| 1,089,340 | 3/1914 | Hemphill | 24/3 M |
| 1,245,515 | 11/1917 | Sarkisian | 24/370 |
| 1,513,383 | 10/1924 | Fleischer | 24/3 H |
| 2,071,757 | 2/1937 | Matthews | 24/3 M |
| 2,531,805 | 11/1950 | Clark | 294/3.6 |
| 2,663,588 | 12/1953 | Scheldorfer | 294/3.6 |
| 2,811,763 | 11/1957 | Jordan | 24/419 |
| 2,908,057 | 10/1959 | Blanco | 294/3.6 |
| 3,017,680 | 1/1962 | Duncan | 294/3.6 |
| 3,145,041 | 8/1964 | Grolig | 294/3.6 |
| 3,284,865 | 11/1966 | Burnham | 294/3.6 |
| 3,704,491 | 12/1972 | Burgess | 294/3.6 |

FOREIGN PATENT DOCUMENTS

| | | | |
|---|---|---|---|
| 896213 | 3/1972 | Canada | 24/429 |
| 2458943 | 12/1975 | Fed. Rep. of Germany | 24/16 PB |
| 0771751 | 4/1957 | United Kingdom | 24/419 |
| 0941150 | 11/1963 | United Kingdom | 24/429 |

*Primary Examiner*—Victor N. Sakran

[57] ABSTRACT

A zipper securing device which comprises of a circular clip open at one end which can be sprung over or around a button as a means of attaching invention to the material in which the zipper is fitted, an eyelet as a means of attachment by sewing and a hook as a means of attachment to the zipper tab securing it in the closed or zipped up position. It also comprises of a connecting member as a means of attaching said hook to said circular clip open at one end and an indentation providing a weakened area to allow a means of seperation between said circular clip open at one end and said connecting member.

1 Claim, 1 Drawing Sheet

ZIPPER SECURING DEVICE

BACKGROUND OF THE INVENTION

1. Field of the Invention

This invention relates to a means of securing zippers in the closed or zipped up position. Zippers often become undone unintentionally, this device eliminates this problem.

2. Description of the Prior Art

Some methods currently used to secure zippers are straight pins or safety pins. These methods can be somewhat tedious when performed several times a day and have an inherent danger of pricking the user. The possibility of these pins coming loose or falling out is also very good.

SUMMARY OF THE INVENTION

This invention provides a convenient and efficient means of securing zippers in the closed or zipped up position. It attaches first to the material above the zipper with a circular clip open at one end which is sprung over or around a button. A typical example of this would be the button on the waist band of trousers. If no suitable button is located or a more permanent means of affixing the device is desired, it could then be sewn on to the material through the eyelet provided especially for this purpose. When the sewing method is used the circular clip open at one end becomes redundant and can be removed by breaking it away along the indentation located between said eyelet and circular clip open at one end. Once the device is suitably affixed and the zipper is in the closed or zipped up position it is then a simple matter of placing the hook which is found on the bottom of the connecting member into an opening on the zipper tab. It is equally as simple to disengage the device when needed.

DESCRIPTION OF THE PREFERRED EMBODIMENT

Figure 1:
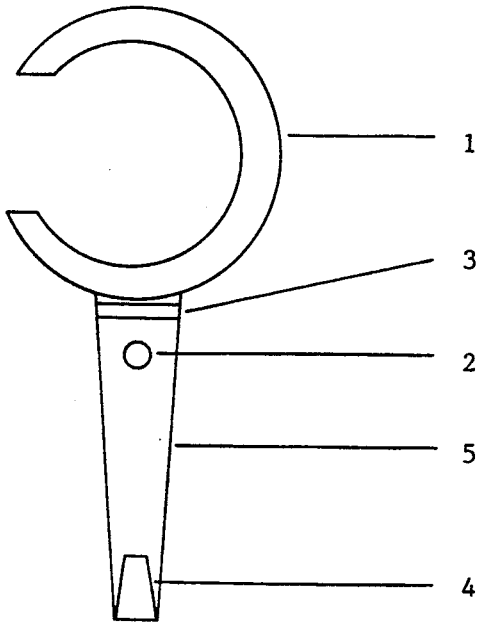
FIG. 1 is a plan view showing an embodiment of the Zipper Securing Device.
Figure 2:
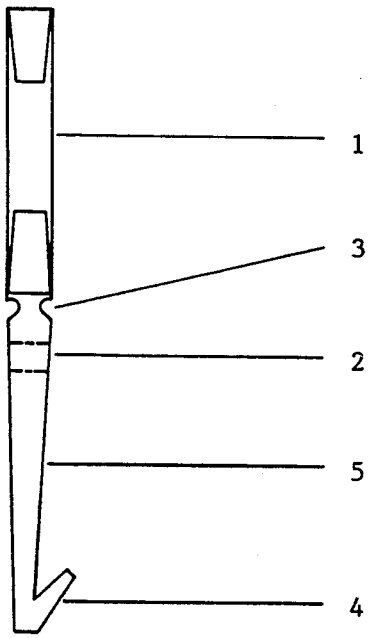
FIG. 2 is a side view of the embodiment of the Zipper Securing Device.

Referring to FIGS. 1 and 2 an embodiment of the invention is shown in which the circular clip open at one end 1 can be sprung over or around a button as a means of attachment, an example of such being the button typicaly found in the waist band closure of trousers. In the event that no button was available or suitable an alternate means of attachment is provided by sewing the device to the material immediately above the zipper through the eyelet 2. If the sewing method of attachment is used the circular clip open at one end 1 becomes redundant and can be removed, if so desired, by breaking it away at the indentation 3 provided for this purpose. After attaching the invention by either method described the hook 4 located at the end of the connecting member 5 is then slipped into the opening of the zipper tab securing the zipper until released.

Although one detailed embodiment of the invention is illustrated in the drawings and previously described in detail, this invention contemplates any configuration and design of components which will accomplish the equivalent result. As an example the invention can be manufactured as an integral part of the zipper tab. As another example the invention could be manufactured as an integral part of buttons, clasps or any other means of garment fasteners. Also it is not intended solely for garment zippers and could be used on all zippers.

I claim:

1. An integral one piece zipper pull tab securing device comprising; a circular clip 1 open at one end thereof which can be sprung around a button as a means of attaching said securing device to the material in which the zipper is fitted and a hook means connected to the other end thereof for engagement with the zipper pull tab for securing the zipper in the closed position, a tapered flat connecting member as a means for joining the circular clip 1 to the hook means, an eyelet means in said connecting member for connecting said member to the material in which the zipper is fitted by sewing and a transverse indentation means extending across the outer surface of said connecting member and located adjacent to the buttton engaging clip 1 providing a weakened area to allow a means of seperation between the circular clip 1 and the connecting member, said connecting member being of sufficient length so that said clip 1 can be engaged with said button when the zipper is in the closed position.

* * * * *

UNITED STATES PATENT AND TRADEMARK OFFICE

CERTIFICATE OF CORRECTION

PATENT NO. : 5,008,985

DATED : April 23, 1991

INVENTOR(S) : Allister W. Thompson

It is certified that error appears in the above-identified patent and that said Letters Patent is hereby corrected as shown below:

On the title page, item [76] Inventor: should read as follows; Allister W. Thompson
#309-1122 Harwood St.
Vancouver, B.C.
Canada, V6E 1R6

Signed and Sealed this

Third Day of November, 1992

*Attest:*

*Attesting Officer*

DOUGLAS B. COMER

*Acting Commissioner of Patents and Trademarks*